United States Patent [19]

Avondoglio

[11] 4,363,640

[45] Dec. 14, 1982

[54] ELECTROSTATIC PRECIPITATOR IMPACTOR ASSEMBLY

[76] Inventor: Leo Avondoglio, 19 Riversedge, Ivoryton, Conn. 06442

[21] Appl. No.: 304,857

[22] Filed: Sep. 23, 1981

[51] Int. Cl.[3] ..... B03C 3/76

[52] U.S. Cl. ..... 55/112

[58] Field of Search ..... 55/13, 112, 124, 126, 55/143, 145, 300

[56] References Cited

U.S. PATENT DOCUMENTS

| | | | |
|---|---|---|---|
| 1,303,008 | 5/1919 | Anderson | 55/300 |
| 3,219,130 | 11/1965 | Steurnagel | 55/13 |
| 3,854,903 | 12/1974 | Tomaides | 55/145 |

FOREIGN PATENT DOCUMENTS

| | | | |
|---|---|---|---|
| 788940 | 1/1958 | United Kingdom | 55/143 |

*Primary Examiner*—Bernard Nozick

*Attorney, Agent, or Firm*—Robert S. Smith

[57] ABSTRACT

An electrostatic precipitator having a collecting cell and an impactor assembly to remove contamination from the collecting plates within the collecting cell. The impactor assembly includes an elongated first member having a major portion of the mass thereof disposed at a first axial extremity, and structure for pivotally mounting the elongated first member at a second axial extremity which allows pivotal motion of the first axial extremity of the elongated first member between first and second positions. The first position is at a higher elevation than the second position and the first axial extremity of the first elongated member is disposed in contacting relationship with the collecting cell in the second position. A cam is provided for urging the elongated first member into the first position which releases the elongated first member for movement under the influence of gravity from the first position to the second position in at least one position of the cam.

3 Claims, 5 Drawing Figures

ELECTROSTATIC PRECIPITATOR IMPACTOR ASSEMBLY

BACKGROUND OF THE INVENTION

The invention relates to electrostatic precipitators and particularly to apparatus for cleaning the collection plates in such apparatus. The apparatus has particular application to precipitators having a capacity in the order of a few hundred cubic feet per minute up to about 6,000 cubic feet per minute. Apparatus of this nature is typically used in restaurants, bars, as well as industrial plants, machine shops, welding shops and the like. Much larger units having air flows of up to 1,000,000 cubic feet per minute are typically installed outdoors and are used in various industrial processes such as in the manufacturer of sulfuric acid. Known large electrostatic precipitators include eccentric cam shaft type mountings for hammers intended for cleaning of the collecting surfaces. Although such apparatus has been used in large electrostatic precipitators, such as those in process industries, such apparatus has not been readily adaptable to smaller installations typically used within commercial buildings.

The basic operating principle of the electrostatic precipitator is demonstrated by the familiar experiment in which a glass rod is rubbed with a slik cloth. The rod is thereby given an electrostatic charge, making it capable of attracting uncharged bits of paper, lint, or cork. In the electrostatic precipitator, the collecting surfaces are gounded, and a charge is created on the particles which are to be collected.

The power supply in such apparatus typically steps up line voltage and rectifies it to produce 5,000 to 15,000 volts of direct current. The direct current voltage is applied to a plurality of discharge electrode wires suspended in the gas flow path. The high potential on the discharge electrodes causes a corona discharge, from which electrons migrate out into the gas. These create gas ions, which attach themselves to particles in the gas and give the particles a charge.

Grounded collecting electrodes are also provided. The high potential difference results in a powerful electric field through which the gas is directed. In accordance with Coulomb's law, the field exerts a force on a charged particle in the field. This force moves particles out of the gas stream to the collecting electrodes. At the grounded collecting electrodes, the particles lose their charge.

The grounded collecting electrodes are typically plate shaped and are enclosed within a removable cell. When the precipitator is functioning properly, the collection plates will eventually become loaded with contaminant. In order to maintain efficiency the contaminants must be removed. The most common method of cleaning the cells, is to remove them from the unit and use a stream of liquid, an air blast, or simply a detergent wash. However, when the units are ceiling-hung (often 10 to 14 feet above the floor) the periodic removal of cells is an inconvenience, and automatic cleaning is desirable.

There are three methods currently used for automatic cleaning: A wash and drain system which requires piping hot water and detergent to each unit; a pneumatic vibrating system which also entails piping high pressure air to each cell which is in turn equipped with several pneumatic pistons; an electrical system which also employs vibrators attached to each cell. The latter system is relatively simple but is not very effective.

The water system is prone to nuisance leakage of the water that is sprayed on the plates. The other methods are only partially effective since a mere vibrating action removes only the outermost layer of the contaminant. Thus the precipitator still has reduced collection efficiency. Each of these methods collect the contaminants in a hopper installed below the cells.

It is an object of the invention to provide apparatus which is particularly suitable for remote installation, such as where the entire precipitator is mounted on the ceiling of a building.

It is another object of the invention to provide apparatus which will require a minimum of periodic maintenance.

It is still another object of the invention to provide apparatus which will be relatively inexpensive.

SUMMARY OF THE INVENTION

It has now been found that these and other objects of the invention are attained in an electrostatic precipitator which includes a collecting cell and an impactor assembly to remove contamination from the collecting cell which includes an elongated first member having a major portion of the mass thereof disposed at a first axial extremity, and means for pivotally mounting the elongated first member at a second axial extremity. The means for pivotally mounting allows pivotal motion of the first axial extremity of the elongated first member between first and second positions. The first position is at a higher elevation than the second position and the first axial extemity of the first elongated member is disposed in contacting relationship with the collecting cell in the second position. Cam means are provided for urging the elongated first member into the first position. The cam means releases the elongated first member for movement under the influence of gravity from the first position to the second postion in at least one position of the cam means. The elongated first member includes a roller cooperating with the cam means. The apparatus further includes an elongated second member having a major portion of the mass thereof disposed at a first axial extremity and means for pivotally mounting the elongated second member at a second axial extremity, the elongated first member and the elongated second member being fixed together in generally coplanar relationship and mounted for movement about a common axis. The collecting cell includes a striker bar extending across the collecting cell. The collecting cell has a plurality of plates disposed in mutually parallel relationship and each of the elongated members moves through a path within a plane which is parallel to the collecting plates.

BRIEF DESCRIPTION OF THE DRAWING

The invention will be better understood by reference to the accompanying drawing in which.

DESCRIPTION OF THE PREFERRED EMBODIMENT

By experimentation it has been found that the most effective way to remove the contaminants from the cell plates, is to strike the cell with a sharp blow. If the blow is directed in the plane of the plates the impact produces a shearing action at the interface of the contaminant and the plate. This overcomes the adhering forces and sheds the contaminants in layers.

Figure 1:
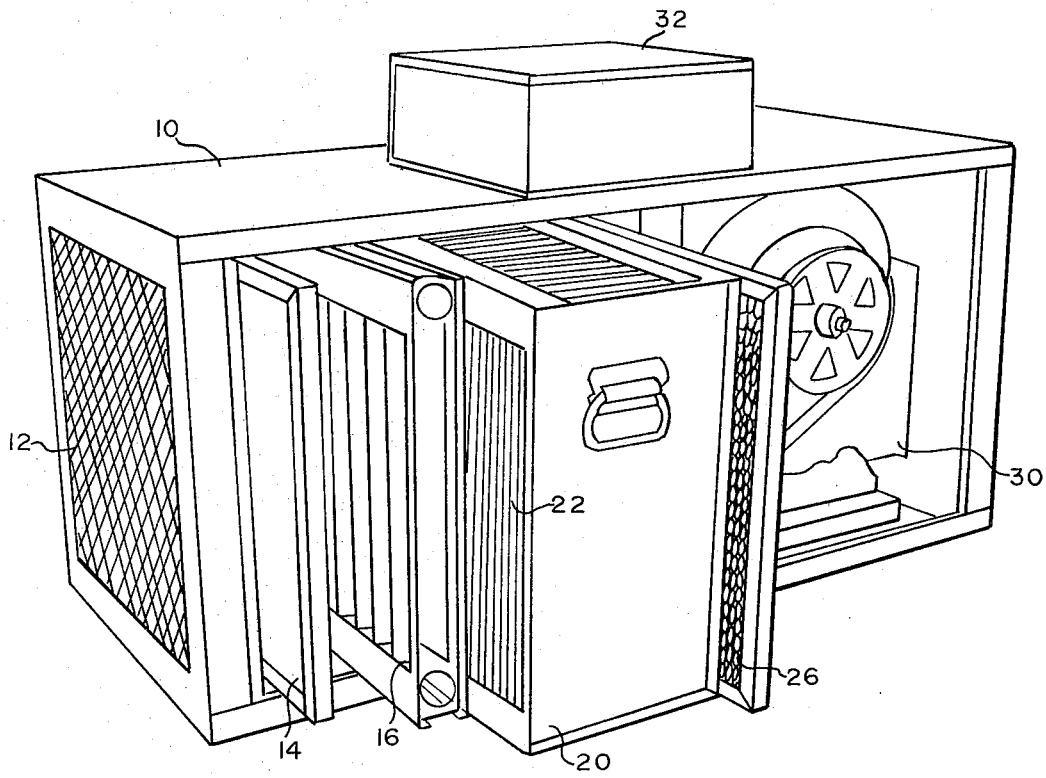
FIG. 1 is a perspective view of an electrostatic precipitator incorporating one form of the apparatus in accordance with the invention.

Referring now to FIG. 1 there is shown a cabinet 10, usually of sheet metal construction, that is open at both ends and serves as a container for the components. It will be understood that this apparatus may be installed either within the room in which the air is to be cleaned or may be connected by ducts to a room in which air is to be cleaned. There is also shown a duct 12 for directing airflow. A prefilter 14 removes large particles and equalizes airflow across the collecting area. An ionizer section 16 carries an array of very fine wires which are maintained at a potential of thousands of volts. The function of the ionizer section 16 is to electrically charge the contaminants as they pass through the cabinet 10. The collecting cell 20 consists of a series of grounded plates 22 parallel to the airflow which are provided to collect the charged contaminants as they pass between the plates 22. A postfilter 26 improves collection efficiency by providing uniform air distribution through the cabinet 10 and arresting any large particles which may be detached from the plates 22. A blower and motor assembly 30 draws the contaminated air through the cabinet 10. A power pack 32 converts 120 V AC to the required high voltage DC.

Figure 2:
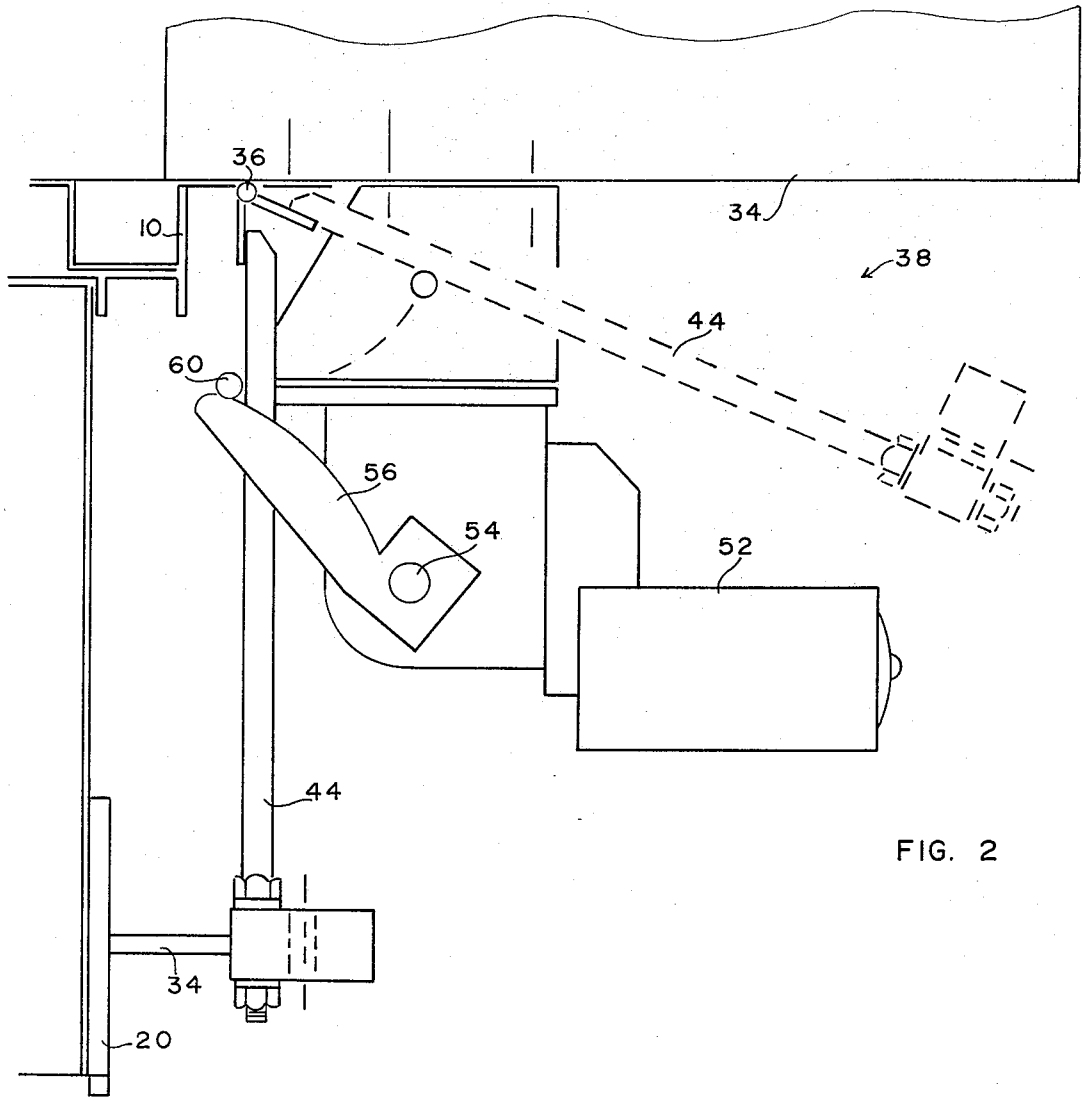
FIG. 2 in which portions of some plates and some entire plates have been omitted for clarity is a side view of an impactor assembly, which is a part of the electrostatic precipitator illustrated in FIG. 1.
Figure 3:
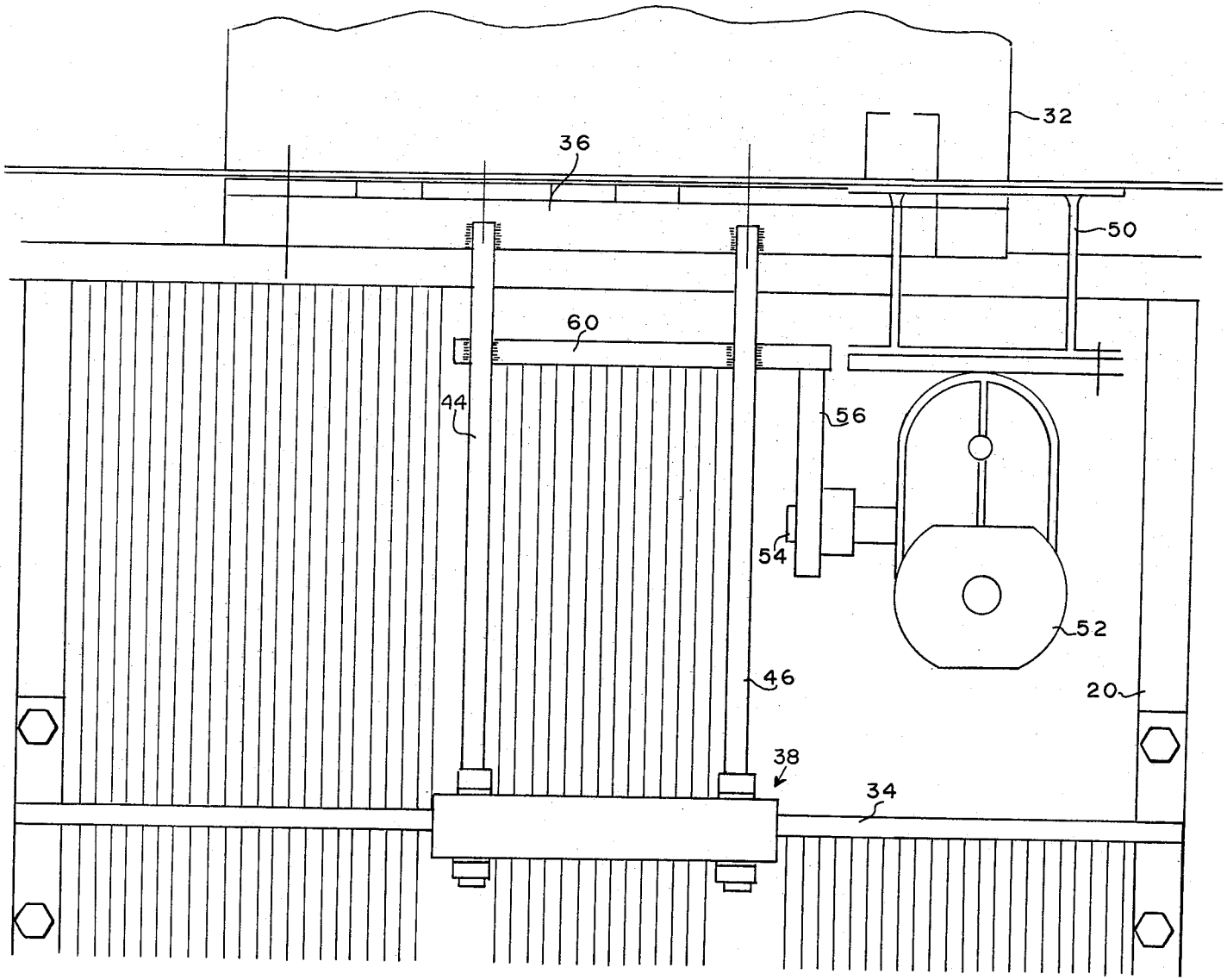
FIG. 3 is a front view of the apparatus illustrated in FIG. 2.

Referring particularly now to FIGS. 2 and 3, there is shown an impactor apparatus, in accordance with the invention, which is particularly suited for cleaning of the collection plates 22 of the collecting cell 20. The collecting cell 20 is provided with a striker bar 34 which extends generally horizontally across one face of the collecting cell 20. A hinge 36 fixed to the housing 10, immediately below the power pack 32, (shown in FIG. 1) carries an elongated striker or impactor assembly 38 which has a head. It will be understood that the head constitutes a center of mass which is substantially heavier than the remainder of the striker assembly 38. As best seen by the solid and phantom line representations of the striker assembly 38 in FIG. 2, the head together with the rest of the striker assembly 38 moves through an arcuate path so that any given part of the striker assembly 38 travels within a plane. Any such plane is parllel to the collection plates 22 which are disposed in aligned relationship with the direction of air flow through the cabinet 10. In the preferred form, the striker assembly 38 includes two discrete identical elongated members 44, 46 which are disposed in mutually parallel spaced apart coplanar relationship. Each of the elongated members 44, 46 are mounted on the hinge or pivot 36 carried by the cabinet 10. The use of two discrete elongated members 44, 46 is preferred since this structure is more rigid than would be true with only a single suspension rod. It will be understood that the invention does also encompass the use of a single suspension rod. Carried on a frame 50 is a right-angle gear motor 52 having an output shaft 54 to which is fixed an elongated cam 56 which travels through a circular path. A bar 60, which may have a roller (not shown) disposed thereon for cooperation with the cam 56, is fixed to the elongated members 44, 46 and has an arcuate path about the hinge pin of the hinge 36, as also best seen in FIG. 2. As the cam 56 moves from the position illustrated in solid line in FIG. 2, the striker assembly 38 is moved upward, to the position illustrated in phantom line, at which time the cam 56 passes under the bar 60 and allows free fall of the striker assembly 38 from a first position (illustrated in phantom) to a second position (illustrated in solid line) against the striker bar 34.

Figure 5:
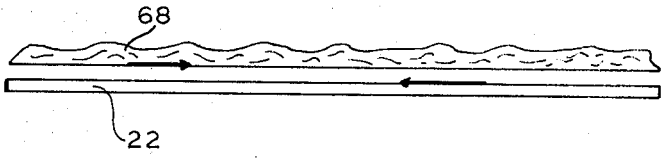
FIG. 5 is a partially schematic view, illustrating the shearing action which causes the contamination to separate from the collecting plates.

As best illustrated in FIG. 5, the direction of movement of the striker assembly 38 is particularly advantageous since the direction of the force produced thereby is aligned with the orientation of the planar collection plates 22. This results in a shearing action intermediate the collection plate 22 and accumulated contaminant 68 which forms in a generally planar mass. This shearing action has been illustrated schematically in FIG. 5.

Ordinarily the motor 52 will be wired to a timer system (not shown) which causes it to run for about one minute every twenty minutes. For various installations the operating cycle may vary from one minute once every hour to one minute once a week.

Figure 4:
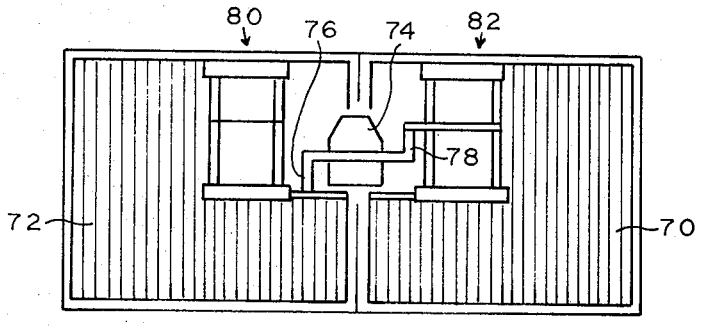
FIG. 4 is a schematic view of an alternate design approach in which portion of some plates and some entire plates have been omitted for clarity.

Referring to FIG. 4, there is shown schematically another form of the invention in which two discrete collecting cells 70, 72 are provided which utilize a single motor 74 driving two discrete cams 76 and 78 which cooperate with two discrete striker assemblies 80 and 82. To minimize the load on the motor 74, the cams 76, 78 are disposed at 180 degree intervals so that only one striker assembly 80, 82 is being raised at any given instant.

The invention has been described with reference to its illustrated preferred embodiment. Persons skilled in the art of constructing electrostatic precipitators may, upon exposure to the teachings herein, conceive variations in the mechanical development of the components therein. Such variations are deemed to be encompassed by the disclosure, the invention being delimited only by the appended claims.

Having thus described my invention I claim:

1. An electrostatic precipitator which comprises:

a collecting cell having at least some grounded electrodes, said cell including a frame carrying said electrodes;

a striker assembly to remove contamination from said collecting cell which includes an elongated first member having a major portion of the mass thereof disposed at a first axial extremity, and means for pivotally mounting said elongated first member at a second axial extremity, said means for pivotally mounting allowing motion of said first axial extremity of said elongated first member between first and second positions, said first position being at a higher elevation than said second position, said first axial extremity of said first elongated member being disposed in contacting relationship with said collecting cell in said second position and spaced apart from said collecting cell in said first position, cam means for urging said elongated first member into said first position, said cam means releasing said elongated first member for movement under the influence of gravity from said first position to said second position in at least one position of said cam means;

said precipitator further includes an elongated second member having a major portion of the mass thereof disposed at a first axial extremity and means for pivotally mounting said elongated second member at a second axial extremity, said elongated first member and said elongated second member being fixed together in generally coplanar relationship and mounted for movement about a common axis; and said collecting cell includes a striker bar extending across said collecting cell.

2. The precipitator as described in claim 1, wherein: said collecting cell has a plurality of plates disposed in mutually parallel relationship and each of said elongated members moves through a path substantially within a plane which is parallel to said collecting plates.

3. The precipitator as described in claim 1, wherein: said apparatus includes two of said striker assemblies and said striker assemblies are disposed in phased relationship with only one being raised to said first position at any given time.

* * * * *